United States Patent [19]

Reynolds

[11] 4,042,976

[45] Aug. 23, 1977

[54] PROTECTIVE COLLAR

[76] Inventor: Jay Carter Reynolds, 134 E. Columbia, Shreveport, La. 71104

[21] Appl. No.: 657,574

[22] Filed: Feb. 12, 1976

[51] Int. Cl.[2] ..... A41B 3/16

[52] U.S. Cl. ..... 2/135; 2/203

[58] Field of Search ..... 2/84, 116, 129, 139, 2/202, 203, 205, 209.1, 2.1, 60, 135

[56] References Cited

U.S. PATENT DOCUMENTS

| | | | |
|---|---|---|---|
| 2,361,786 | 10/1944 | Morner | 2/2.1 R |
| 2,569,693 | 10/1951 | Sacchitella | 2/139 |
| 2,870,452 | 1/1959 | De Grazia | 2/203 |
| 3,825,952 | 7/1974 | Pershing | 2/205 |

*Primary Examiner*—Werner H. Schroeder
*Assistant Examiner*—Doris L. Troutman
*Attorney, Agent, or Firm*—John M. Harrison

[57] ABSTRACT

A protective collar for shielding the wearer against inclement weather which includes a strip of waterproof material having loop pile fasteners along the edges and the top thereof, the bottom edge of which is designed to attach to a windbreaker or other protective garment and the top loop pile edge to a helmet, protective hood, or hat.

8 Claims, 4 Drawing Figures

PROTECTIVE COLLAR

BACKGROUND OF THE INVENTION

1. Field of the Invention

This invention relates to protective accessory garments for use in inclement weather and more particularly, to a protective collar for use in cooperation with a windbreaker or other protective garment and a helmet used when riding motorcycles or other vehicles under circumstances where the rider is exposed to the elements.

2. Description of the Prior Art

Heretofore, protective garments for motorcycle riders and others such as racing car drivers, including dirt track drivers who are exposed to the elements while driving have been limited to such devices as masks, high collars and hoods which frequently offer little protection from a cold wind and/or rain, particularly in the area of the neck. Typical of the prior art protective garments is the disclosure in U.S. Pat. No. 3,688,314 to Rodney S. Hill. This patent discloses a protective environmental suit having a collar adapted to snap onto the wearer's helmet. The collar is equipped with an elaborate sealing means designed to removably cooperate with the specially designed helmet.

Accordingly, it is an object of this invention to provide a new and improved accessory garment which can be permanently or removably attached to a windbreaker or other protective garment and can likewise be removably attached to a hat, hood or helmet to protect the neck area of a wearer from wind and inclement weather.

Another object of the invention is to provide a protective collar which may be removably fitted to a windbreaker or other protective garment and a helmet or other head covering to protect the neck area of a user from wind, rain, sleet or snow.

A still further object of the invention is to provide a protective collar fitted with loop pile fasteners, snaps or zippers for removable attachment to a windbreaker or other protective garment and to a helmet to provide protection to the neck area of a user.

Yet another object of this invention is to provide a protective collar, the bottom of which can be either removably or permanently fitted to a windbreaker or other protective garment and which is equipped with closure means such as loop pile fasteners along the top and both ends thereof in order to mate with a cooperating loop pile-fitted flap secured to the helmet of a user and designed to prevent wind and water from entering the flap-collar interface when the user is exposed to wind or inclement weather.

SUMMARY OF THE INVENTION

These and other embodiments of the invention are provided in a protective collar which includes a length of protective material having a closure means such as loop pile fasteners, snaps or zippers on each end and the top thereof, and in a preferred embodiment of which, the collar bottom is sewn to a windbreaker or other protective garment. In another embodiment where the collar is removably attached to the windbreaker or other garment, an additional set of snaps, a zipper or a velcro attachment can be fitted to the bottom of the collar to cooperate with a fastener on the windbreaker. The top portion of the collar is removably fitted to a helmet or other head covering, as above described.

BRIEF DESCRIPTION OF THE DRAWINGS

The invention will be better understood in view of the following description presented with reference to the accompanying drawing.

DESCRIPTION OF THE PREFERRED EMBODIMENTS

Figure 1:
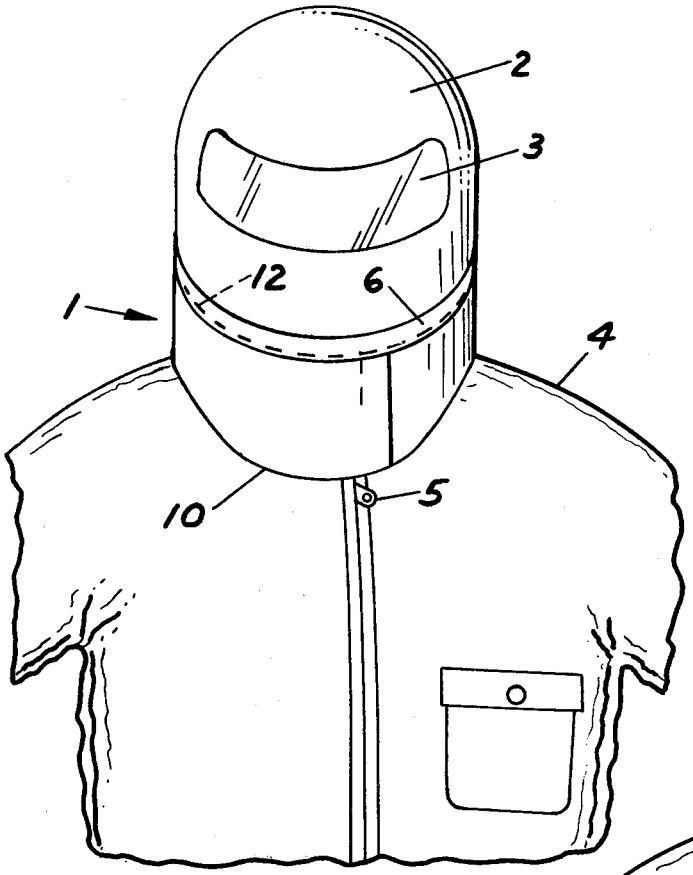
FIG. 1 of the drawing is a perspective front view of the protective collar of this invention illustrated in functional position attached to a windbreaker and helmet of a user.
Figure 2:
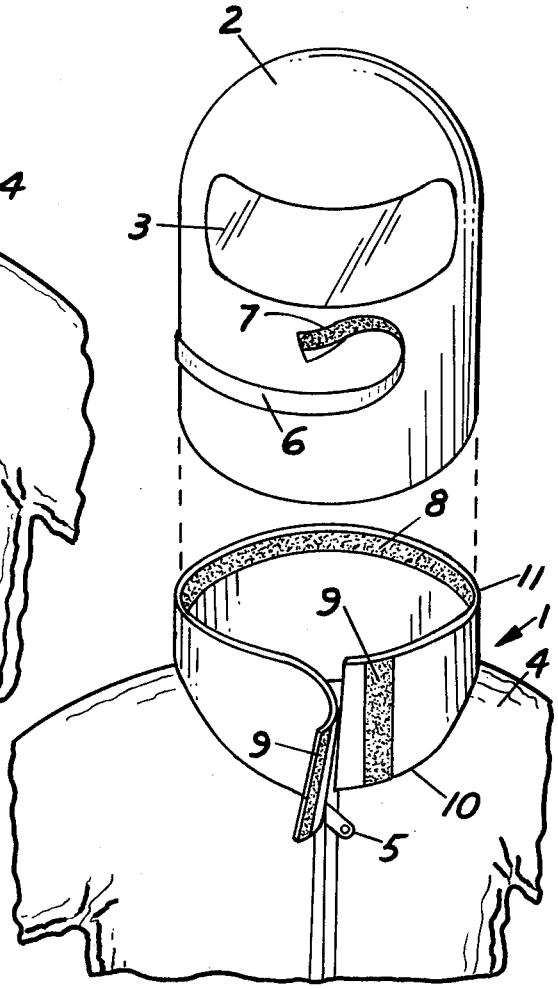
FIG. 2 is a perspective front view of the collar, helmet, and windbreaker, more particularly illustrating a cooperating flap which acts to seal the collar-helmet interface when the collar is in functional position on the helmet.

Referring now to FIGS. 1 and 2 of the drawing, protective collar 1 is illustrated in position between helmet 2 and windbreaker 4. Face shield 3 of helmet 2 serves to permit protected viewing of the wearer, and is slidably disposed on helmet 2. Zipper 5 serves to close windbreaker 4 and collar bottom 10 can either be sewn or removably attached by means of a zipper, snaps, loop pile fasteners, or other closure means to windbreaker 4, as desired.

Figure 3:
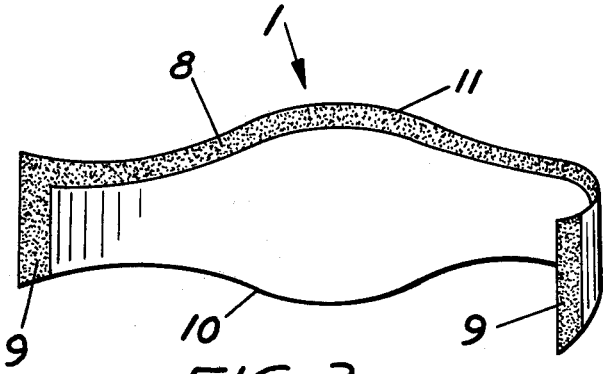
FIG. 3 is a perspective view of the protective collar stretched to full length and more particularly illustrating the preferred loop pile fasteners attached thereto.
Figure 4:
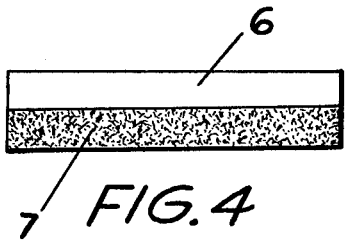
FIG. 4 is a front elevation of the cooperating protective flap which attaches to the helmet or other head covering and seals the helmet-collar interface.

As illustrated in FIGS. 1, 2 and 4, waterseal flap 6, with cooperating loop pile fastener 7 is glued or otherwise fastened to helmet 2 in order to seal protective collar-helmet interface 12, illustrated in FIG. 1. Thus, when perimeter loop pile fastener 8, attached to collar top 11 of protective collar 1 is mated to waterseal flap loop pile fastener 7, and waterseal flap 6 is folded downwardly over protective collar-helmet interface 12, as illustrated in FIGS. 1 and 2, the neck area of the user is sealed from wind, rain, snow or sleet. It will be appreciated that simultaneously with the above sealing operation, vertical loop pile seals 9 positioned on each end and on opposite sides of protective collar 1 as illustrated in FIG. 3 are pressed together to removably close protective collar 1.

Referring again to FIG. 3 of the drawing, it will be appreciated that collar bottom 10 of protective collar 1 can be fitted with a loop pile fastener or alternative closure means to mate with a cooperating closure means fitted to the neck of windbreaker 4. In this manner, protective collar 1 can be easily snapped, zipped or otherwise secured into position on windbreaker 4 as desired.

It will be appreciated by those skilled in the art and as heretofore noted, that while it is desired to use loop pile fasteners to secure protective collar 1 onto helmet 2, alternative means, including zippers and snaps can be utilized, as desired. For example, referring again to FIG. 3 of the drawing, a zipper can be fitted to collar top 11 of protective collar 1 in place of perimeter loop pile fastener 8, and vertical loop pile fasteners 9 can also be replaced by a zipper. A cooperating zipper can be fitted to waterseal flap 6 in the place of waterseal flap loop pile fastener 7 to mate with the zipper on collar top 11. Alternatively, other closures such as snaps can be utilized to effect the fastening functions described above. In similar fashion, while it is preferred to glue waterseal flap 6 onto helmet 2, snaps or other fasteners can be used as desired.

While the protective collar of this invention is particularly useful in cooperation with helmets, it will be appreciated that it can easily be used with headgear such as "pullover" ski masks and hoods in the manner described above with regard to helmets. The ski mask, for example, can be fitted with loop pile fasteners or other fastening means to securely position protective collar 1 in place.

Having described my invention with the particularity set forth above, what is claimed is:

1. A protective collar comprising:

a. A length of protective material for encircling the neck of a wearer and having closure means on the inside perimeter of the top, the front side of one end, and the rear side of the opposite end thereof for mating said front side and said rear side; and b. A water seal flap fastened to and encircling a head covering and having a cooperating flap closure means facing outwardly of said head covering for mating with said closure means on said inside perimeter of the top of said protective material and securing said protective collar to said water seal flap when said head covering is worn and said protective collar is fitted around the bottom of said head covering and the neck of a wearer.

2. The protective collar of claim 1 wherein the bottom of said protective collar is permanently fitted to said protective garment.

3. The protective collar of claim 1 further including closure means attached to the bottom perimeter of said protective collar and a cooperating and mating closure means on said protective garment for removably joining said bottom of said protective collar to said protective garment.

4. The protective collar of claim 1 wherein said closure means is a loop pile fastener, a set of buttons, a set of snaps, or a zipper.

5. The protective collar of claim 1 wherein:

a. the bottom of said protective collar is permanently fitted to said protective garment; and b. said closure means is a loop pile fastener, a set of buttons, a set of snaps or a zipper.

6. The protective collar of claim 1 further including a loop pile fastener, a set of buttons, a set of snaps, or a zipper attached to the bottom perimeter of said protective collar and a cooperating and mating closure means on said protective garment for joining said bottom of said protective collar to said protective garment.

7. The protective collar of claim 1 wherein said head covering is a helmet.

8. The protective collar of claim 1 wherein:

a. the bottom of said protective collar is permanently fitted to said protective garment;

b. said closure means is a loop pile fastener, a set of buttons, a set of snaps or a zipper; and c. said head covering is a helmet.

* * * * *